US010041685B2

(12) United States Patent
Kim et al.

(10) Patent No.: US 10,041,685 B2
(45) Date of Patent: Aug. 7, 2018

(54) HINGE APPARATUS AND OVEN WITH THE SAME

(71) Applicant: LG Electronics Inc., Seoul (KR)

(72) Inventors: Kihwan Kim, Seoul (KR); Sungho Choi, Seoul (KR)

(73) Assignee: LG Electronics Inc., Seoul (KR)

( * ) Notice: Subject to any disclaimer, the term of this patent is extended or adjusted under 35 U.S.C. 154(b) by 239 days.

(21) Appl. No.: 15/060,883

(22) Filed: Mar. 4, 2016

(65) Prior Publication Data

US 2016/0273777 A1 Sep. 22, 2016

(30) Foreign Application Priority Data

Mar. 16, 2015 (KR) ..... 10-2015-0036060

(51) Int. Cl.
*E05F 1/08* (2006.01)
*F24C 15/02* (2006.01)
(Continued)

(52) U.S. Cl.
CPC ..... *F24C 15/023* (2013.01); *E05F 1/1246* (2013.01); *E05F 5/02* (2013.01); *E05Y 2201/21* (2013.01); *E05Y 2201/254* (2013.01); *E05Y 2201/264* (2013.01); *E05Y 2600/53* (2013.01); *E05Y 2900/308* (2013.01)

(58) Field of Classification Search
CPC ... F16F 15/03; F16F 6/00; F16F 6/005; F24C 15/02; F24C 15/023; E05F 1/1276; E05F 1/1292; E05F 1/1253; E05F 3/02; E05F 3/10; E05F 1/1261; E05Y 2201/41; E05Y 2201/412; E05Y 2201/414; E05Y 2201/416; E05Y 2201/40; E05Y 2201/46; E05Y 2900/30; E05Y 2900/308; E05D 11/1064; E05D 3/18; Y10T 16/5383
See application file for complete search history.

(56) References Cited

U.S. PATENT DOCUMENTS 1,700,086 A * 1/1929 Sherwood ..... E05F 5/02 16/286
8,601,644 B1 * 12/2013 Chen ..... E05F 5/006 16/286
(Continued)

FOREIGN PATENT DOCUMENTS

CN 104394750 3/2015
DE 10-2007-029696 1/2009
(Continued)

*Primary Examiner* — Chuck Mah
(74) *Attorney, Agent, or Firm* — Fish & Richardson P.C.

(57) ABSTRACT

Provided is a hinge apparatus and an oven with the same. The oven with a hinge apparatus includes a main body having a cooking space; a door configured to open and close the cooking space; and the hinge apparatus configured to connect the main body with the door, and at which the door is rotatably installed, wherein the hinge apparatus includes a hinge unit which includes a hinge body fixed to the main body, and a hinge lever which is coupled to the door and also rotatably shaft-coupled to the hinge body by a hinge pin; and a damping unit which is installed at an outer surface of the hinge body within a radius of rotation of the hinge lever, and is in contact with the hinge lever to reduce a rotating speed of the hinge lever when the hinge lever is rotated.

29 Claims, 14 Drawing Sheets

(51) Int. Cl.
*E05F 1/12* (2006.01)
*E05F 5/02* (2006.01)

(56) References Cited

U.S. PATENT DOCUMENTS

2002/0046441 A1* 4/2002 Brustle ..... E05F 5/006 16/254
2003/0056328 A1* 3/2003 Habegger ..... E05F 1/1276 16/343
2003/0200625 A1* 10/2003 Zimmer ..... E05F 5/006 16/306
2004/0205935 A1* 10/2004 Lautenschlaeger ..... E05D 3/142 16/374
2005/0177980 A1* 8/2005 Herper ..... E05F 5/006 16/366
2007/0283532 A1* 12/2007 Vanini ..... E05F 1/1261 16/277
2008/0092333 A1* 4/2008 Migli ..... E05F 5/006 16/221
2008/0098565 A1* 5/2008 Migli ..... E05F 5/006 16/239
2008/0289144 A1* 11/2008 Vanini ..... E05F 1/1261 16/221
2009/0165244 A1* 7/2009 Pyo ..... E05F 5/006 16/250
2010/0127606 A1* 5/2010 Collene ..... E05F 1/1292 312/327
2010/0212112 A1* 8/2010 Steurer ..... E05F 1/1261 16/286
2010/0258986 A1* 10/2010 Chen ..... E05F 5/02 267/124
2010/0281650 A1* 11/2010 Kleemann ..... A47L 15/4261 16/64
2011/0068671 A1* 3/2011 Vanini ..... E05F 5/02 312/405
2012/0067333 A1* 3/2012 Mirshekari ..... E05F 1/1041 126/192
2012/0180261 A1* 7/2012 Zimmer ..... E05F 5/006 16/319
2012/0260461 A1* 10/2012 Lautenschlager ..... E05D 3/14 16/352
2013/0055528 A1* 3/2013 Lowe ..... E05F 5/08 16/85
2014/0130302 A1* 5/2014 Bettinzoli ..... E05F 1/1261 16/304
2016/0024829 A1* 1/2016 Lowe ..... E05F 5/006 16/85
2016/0169529 A1* 6/2016 Deng ..... F24C 15/023 126/191
2016/0348414 A1* 12/2016 Ivanovic ..... E05F 5/02

FOREIGN PATENT DOCUMENTS

EP 1764557 A2 * 3/2007 ..... A47L 15/4261
EP 2284344 A2 * 2/2011 ..... E05F 1/1058
EP 2562341 2/2013
EP 2687786 1/2014
GB 684207 12/1952
GB 2043764 A * 10/1980 ..... A01G 9/241
GB 2252787 8/1992
JP H11-297287 10/1999
JP 2007-240149 9/2007
JP 2009139020 6/2009
KR 20-1992-0010468 6/1992
KR 10-2008-0101050 11/2008
KR 10-2009-0095382 9/2009
KR 10-2012-0019787 3/2012

* cited by examiner

HINGE APPARATUS AND OVEN WITH THE SAME

CROSS-REFERENCE TO RELATED APPLICATION(S)

This application claims priority under 35 U.S.C. § 119 and 35 U.S.C. § 365 to Korean Patent Application No. 10-2015-0036060, filed in Korea on Mar. 16, 2015, whose entire disclosure is hereby incorporated by reference.

BACKGROUND

1. Field

A hinge apparatus and an oven with the same are disclosed herein.

2. Background

Generally, an oven (or an oven range) is an appliance in which food to be cooked is put in a cooking space thereof, and then heated and cooked after a door thereof is closed.

Such an oven is formed so that the cooking space is opened and closed by a hinge apparatus which connects a main body forming the cooking space with the door, while the door is rotated.

The hinge apparatus is formed so the door is more safely and slowly opened to ensure user safety from heat generated upon a cooking operation, when the food is cooked using the oven, and also smoothly closed.

In Korean Patent Publication No. 10-2012-0020213, there is disclosed a hinge apparatus for an oven, in which a damping means is connected to a hinge shaft of a door member of the hinge apparatus so as to provide resistance when a door is closed, such that the door is slowly closed.

However, since the hinge apparatus having such a structure has a very complicated structure, there are some problems that a manufacturing cost is increased, and productivity is lowered. Also, there is another problem that, when the hinge apparatus is installed at a main body, an installation space is restricted by the damping means which protrudes in a lateral direction of the hinge apparatus.

In Korean Patent Publication No. 10-2012-0019787, there is disclosed a door hinge apparatus for an oven, in which a roller which is folded when a door member is rotated is installed at a guide member inside a housing of the hinge apparatus, and a damper member which enables a door to be slowly closed by hydraulic resistance when the door member is rotated is provided at an end of the guide member.

However, in the hinge apparatus having such a structure, since all of the roller, the guide member and the damper member should be accommodated in the housing, there are some problems that an internal structure of the housing becomes complicated, and a manufacturing cost is increased.

Also, when a size of the hinge apparatus is changed according to a type of the oven, an arrangement of the roller, the guide member and the damper member provided inside the housing is also changed, and thus it is difficult to apply the hinge apparatus to various products.

SUMMARY

The present invention is directed to a hinge apparatus in which a damping unit which is directly in contact with a rotary hinge lever is provided outside a hinge body so as to reduce a closing speed of a door, thereby ensuring user safety and reducing a noise, and an oven with the same.

According to an aspect of the present invention, there is provided an oven with a hinge apparatus, including a main body having a cooking space; a door configured to open and close the cooking space; and the hinge apparatus configured to connect the main body with the door, and at which the door is rotatably installed, wherein the hinge apparatus includes a hinge unit which includes a hinge body fixed to the main body, and a hinge lever which is coupled to the door and also rotatably shaft-coupled to the hinge body by a hinge pin; and a damping unit which is installed at an outer surface of the hinge body within a radius of rotation of the hinge lever, and is in contact with the hinge lever to reduce a rotating speed of the hinge lever when the hinge lever is rotated.

The hinge apparatus may be provided at each of left and right sides of the main body, and the damping unit may be provided at only one of both of left and right hinge units.

The hinge body may be installed and fixed to a lower plate which forms a lower surface of the main body, and the damping unit may be installed at an upper surface of the hinge body.

The damping unit may pass through a front plate which forms a front surface of the main body, and may be exposed forward.

A front surface of the damping unit and a front surface of the front plate may be located on the same plane.

A hinge hole through which the hinge body and the damping unit pass may be formed at the front plate.

The hinge hole may be opened to have a corresponding shape, such that a circumferential surface of the hinge body and a front surface of the damping unit are restricted.

The damping unit may be provided at a space which is formed by a cavity plate defining the cooking space, a front plate forming a front surface of the main body, and a lower plate forming a lower surface of the main body.

The damping unit may include a damper case which is fixed to the hinge body; and a damper which includes a housing installed at the damper case and filled with oil and a shaft provided at the housing to be moved in and out, and the shaft may pass through a front surface of the main body and may protrude, and may be pressed by the hinge lever when the hinge lever is rotated.

According to another aspect of the present invention, there is provided a hinge apparatus including a hinge unit including a hinge body fixed to a main body of an oven, and a hinge lever which is coupled to a door of the oven and also rotatably shaft-coupled to the hinge body by a hinge pin; and a damping unit which is installed at an outer surface of the hinge body within a radius of rotation of the hinge lever, and is in contact with the hinge lever to reduce a rotating speed of the hinge lever when the hinge lever is rotated.

A contacting part which protrudes toward the damping unit and presses a shaft of the damping unit when the hinge lever is rotated may be formed at the hinge lever.

A first coupling hole to which the damping unit is hooked and restricted may be provided at an upper surface of the hinge body.

One pair of first case fixing protrusions which are formed in a hook shape and inserted into the first coupling hole may be further formed at both sides of a lower surface of the damping unit.

A second coupling hole in which a screw passing through the damping unit is fastened may be further formed at the upper surface of the hinge body.

A third coupling hole in which a second case fixing protrusion protruding from a lower surface of the damping unit is inserted so as to restrict backward movement may be formed at the upper surface of the hinge body.

The damping unit may include a damper case which is installed and fixed to the hinge body; and a damper which includes a housing installed at the damper case and filled with oil and a shaft provided to be in contact with the hinge lever and to be moved in and out of the housing.

The damper case may be opened upward, and the damper may be fitted and installed through an opened upper surface of the damper case.

A housing support part which protrudes to be in contact with the housing may be formed at a lower surface of the damper case, and the housing support part may include a first support part which extends along a center of the housing, and a second support part which is formed at a predetermined interval along the first support part to intersect with the first support part and has a corresponding curved surface to cover an outer surface of the housing.

The damper case may include a front fixing part which is formed by extending upward a part of each of left and right side surfaces of the damper case, and presses and fixes the outer surface of the housing, and a rear fixing part which forms a space at a rear end of the damper case and in which a rear end of the housing is inserted.

The front fixing part may be formed to be rounded inward with a curvature corresponding to the outer surface of the housing, and a bottom hole may be formed at a lower surface of the damper case corresponding to a lower end of the front fixing part.

A front pressing part which protrudes to be in contact with the outer surface of the housing may be formed at an inner surface of the front fixing part.

A recessed part which accommodates a part of the outer surface of the housing may be further formed at an inner surface of the front fixing part.

A cut-away part which is formed by cutting a side surface of the damper case to provide elasticity to the front fixing part may be formed at both sides of the front fixing part.

The rear fixing part may include a rear surface which extends upward from an end of the damper case so as to support the housing; and one pair of extending parts which extend from both of side surfaces and the rear surface of the damper case to cover the housing and also to be spaced apart from each other.

A plurality of rear pressing parts which extend in a lengthwise direction of the extending parts and protrude inward so as to press and fix the outer surface of the housing when the housing is inserted may be formed at inner surfaces of the extending parts.

A shaft cap which passes through the damper case and is in contact with the hinge lever may be provided at a front end of the shaft.

A plurality of guide parts which extend in an extending direction of the shaft cap and protrude radially at predetermined intervals may be formed at an outer circumferential surface of the shaft cap.

A shaft hole through which the shaft cap passes may be formed at a front surface of the damper case.

A cap protrusion which protrudes laterally may be formed at an outer surface of the shaft cap, and an alignment groove which is further recessed outward so that the cap protrusion passes may be further formed at one side of the shaft hole.

One pair of shaft guide parts which are disposed to be spaced apart from each other and support the guide parts so as to prevent eccentricity of the shaft cap may be further formed inside the damper case.

The details of one or more embodiments are set forth in the accompanying drawings and the description below. Other features will be apparent from the description and drawings, and from the claims.

BRIEF DESCRIPTION OF THE DRAWINGS

Embodiments will be described in detail with reference to the following drawings in which like reference numerals refer to like elements, and wherein.

DETAILED DESCRIPTION

Reference will now be made in detail to the embodiments of the present disclosure, examples of which are illustrated in the accompanying drawings. The invention may, however, be embodied in many different forms and should not be construed as being limited to the embodiments set forth herein; rather, alternative embodiments included in other retrogressive inventions or falling within the spirit and scope of the present disclosure can easily be derived through adding, altering, and removing, and will fully convey the concept of the invention to those skilled in the art.

For convenience of explanation and understanding, the embodiment of the present invention will describe an oven as an example. However, the present invention may be applied to various cooking appliances of which doors are rotated forward and opened using a lower end of the door as a rotating axis.

Figure 1:
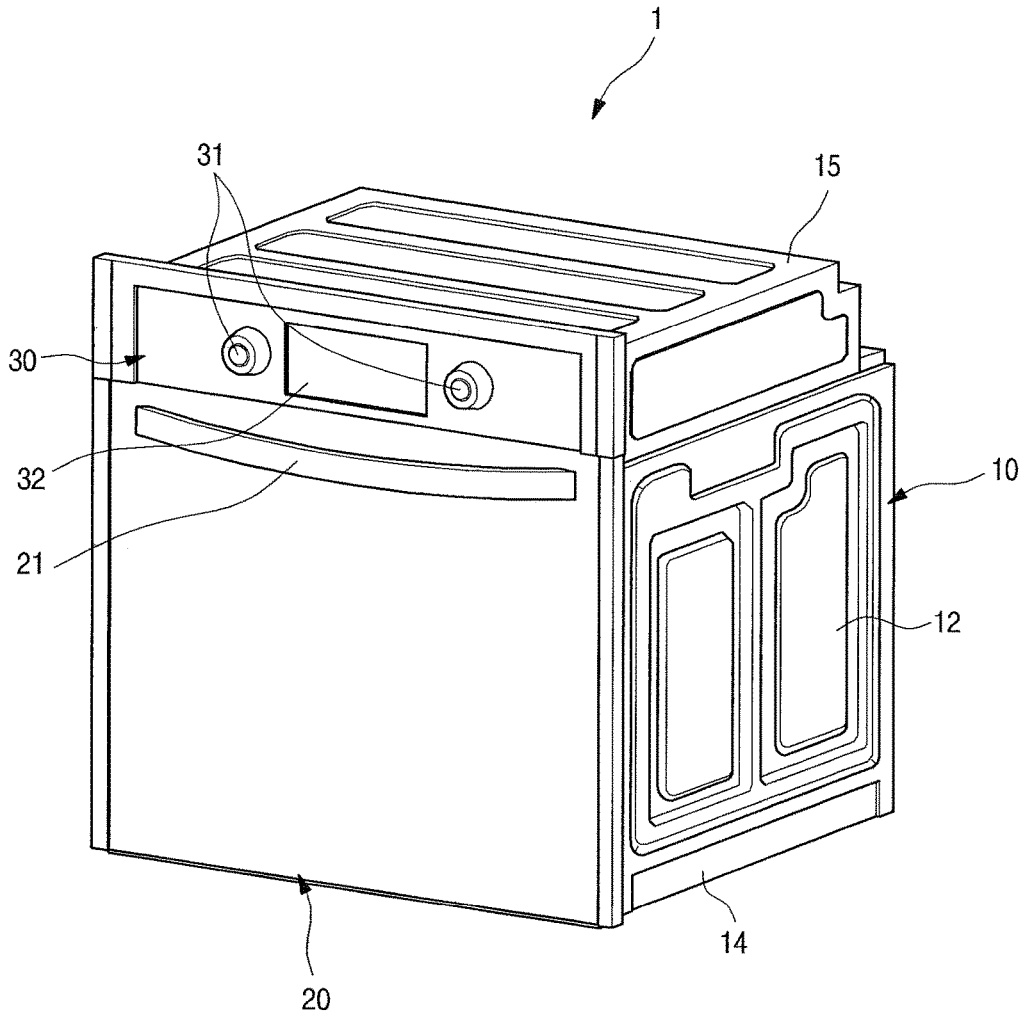
FIG. 1 is a perspective view of an oven according to one embodiment of the present invention.
Figure 2:
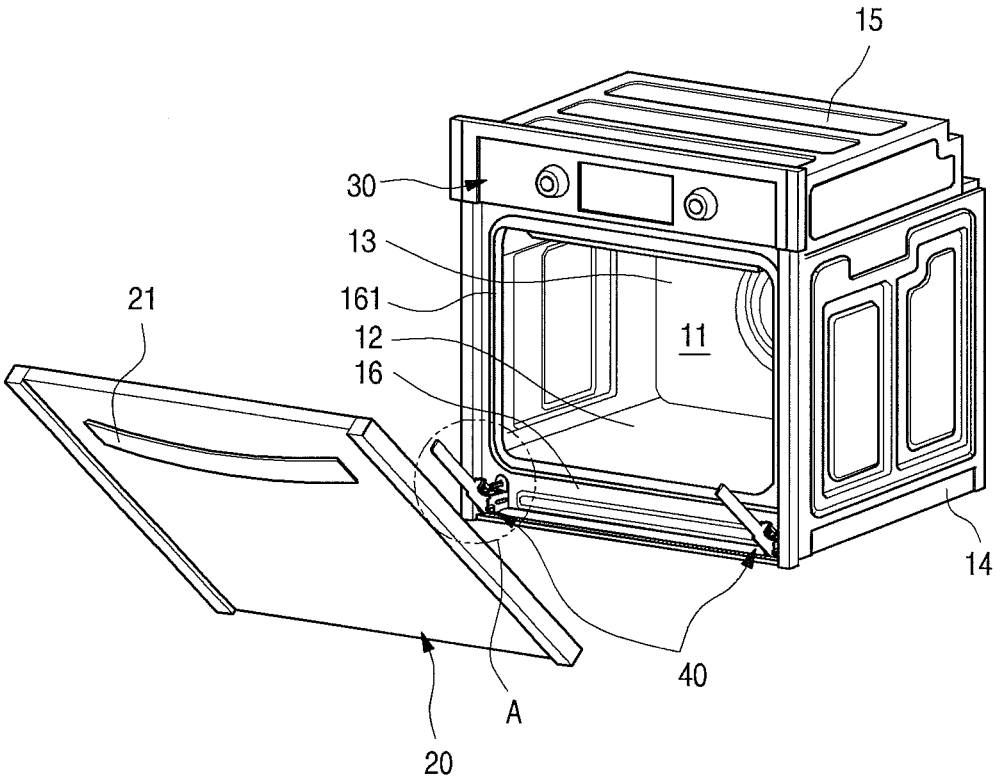
FIG. 2 is an exploded perspective view illustrating a state in which a door of the oven is disassembled.

FIG. 1 is a perspective view of an oven according to one embodiment of the present invention. And FIG. 2 is an exploded perspective view illustrating a state in which a door of the oven is disassembled.

As illustrated in the drawings, an overall external appearance of an oven 1 according to an embodiment of the present invention may be formed by a main body 10 which has a cooking space 11 formed therein, and a door 20 which is provided at a front surface of the main body 10 to be opened and closed and thus to selectively open and close the cooking space 11.

Specifically, the main body 10 is formed in a hexahedral shape, and the cooking space 11 which is opened forward is formed therein. The main body 10 may include a cavity plate 12 and a rear plate 13 which define the cooking space 11, a lower plate 14 which forms a lower surface of the main body 10, an upper plate 15 which forms an upper portion of the main body 10, and a front plate 16 which forms the front surface of the main body 10.

The cavity plate 12 and the rear plate 13 are coupled to each other, and form the cooking space 11 which is opened forward. The oven 1 according to the embodiment of the present invention is installed in a built-in method in which a separate outer case which forms the external appearance is omitted. Of course, when the built-in method is not applied, if necessary, the outer case which forms the external appearance may be further provided at the main body 10.

An operation part 30 may be further formed at the upper portion of the main body 10. The operation part 30 is located above the cooking space 11, and may be provided at an area separated from the cooking space 11.

The operation part 30 may include an operating knob 31 and a touch display 32 which are exposed on the front surface of the main body 10, and a user may control an operation of the oven 1, and may also check an operating state through an operation of the operating knob 31 and the touch display 32.

The remaining surfaces except the front surface of the operation part 30 may be formed by the upper plate 15, and the upper plate 15 may provide a space in which various electronic components for operating the oven 1 are disposed.

The front plate 16 has a quadrangular shape, forms the front surface of the main body 10, and also forms an opening of the cooking space 11. And a gasket 161 may be provided along a perimeter of the opening of the front plate 16, and may be formed to seal the cooking space 11 while the door 20 is closed. And a hinge apparatus 40 which will be described below is disposed at a lower end of the front plate 16.

The door 20 may be rotatably installed at the main body 10 by the hinge apparatus 40, and the cooking space 11 may be selectively opened or closed by rotation of the door 20. The door 20 has a quadrangular plate shape, forms an external appearance of the front surface of the main body 10 while being closed, and is formed to completely shield a front of the front plate 16.

Both sides of a lower end of a rear surface of the door 20 are coupled to the hinge apparatus 40, and thus the door 20 may be rotated by the hinge apparatus 40. At this point, the door 20 and the hinge apparatus 40 may be separably coupled to each other. That is, while the hinge apparatus 40 is installed at the main body 10, the door 20 may be formed to be coupled to or separated from the hinge apparatus 40.

A door handle 21 is formed at an upper end of a front surface of the door 20 to transversely extend long. The user may rotate the door 20 by gripping and then pushing or pulling the door handle 21. At this point, the door 20 may be rotated by the hinge apparatus 40 provided at a lower end of the door 20.

Figure 3:
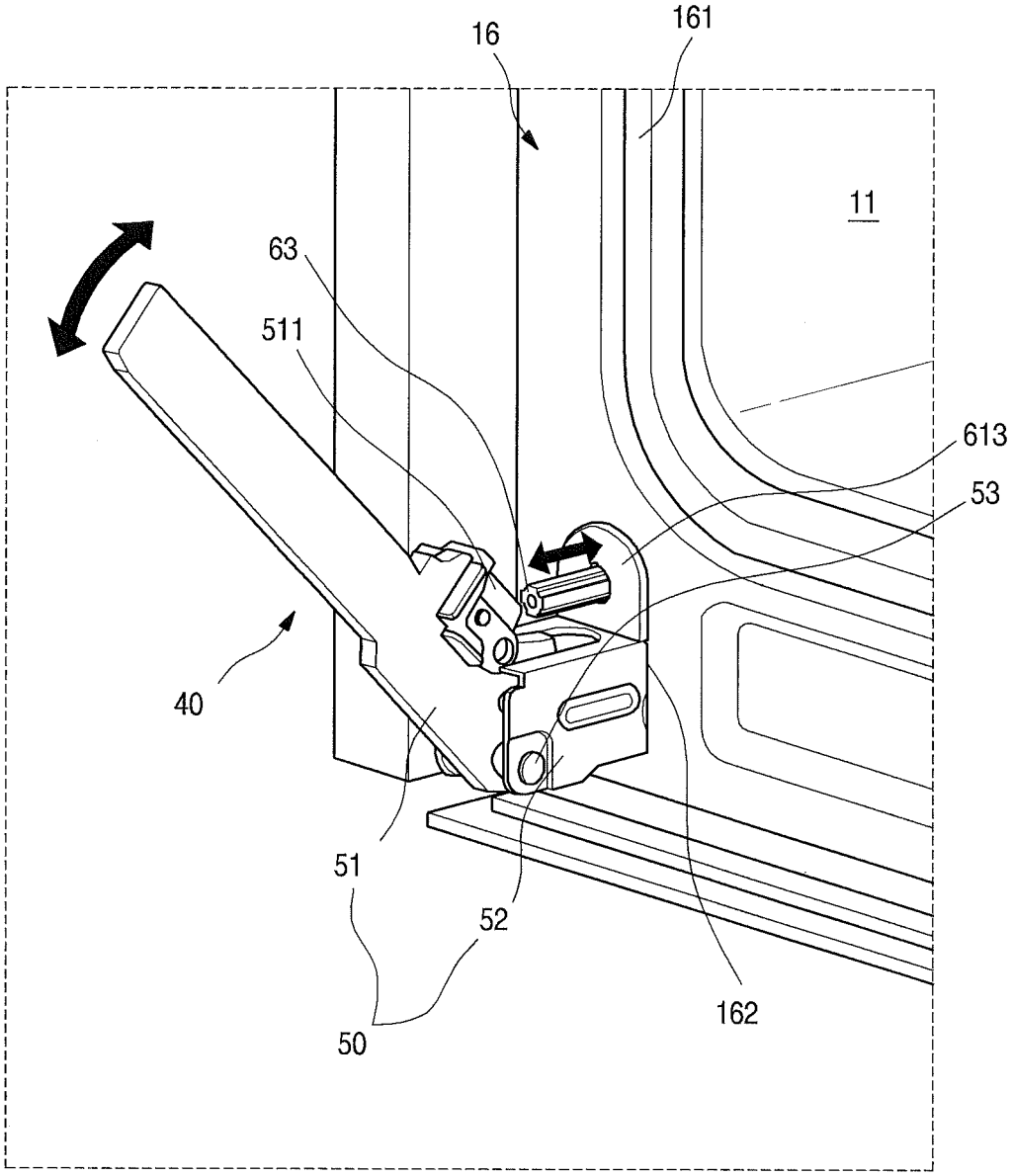
FIG. 3 is an enlarged view of an A portion of FIG. 2.
Figure 4:
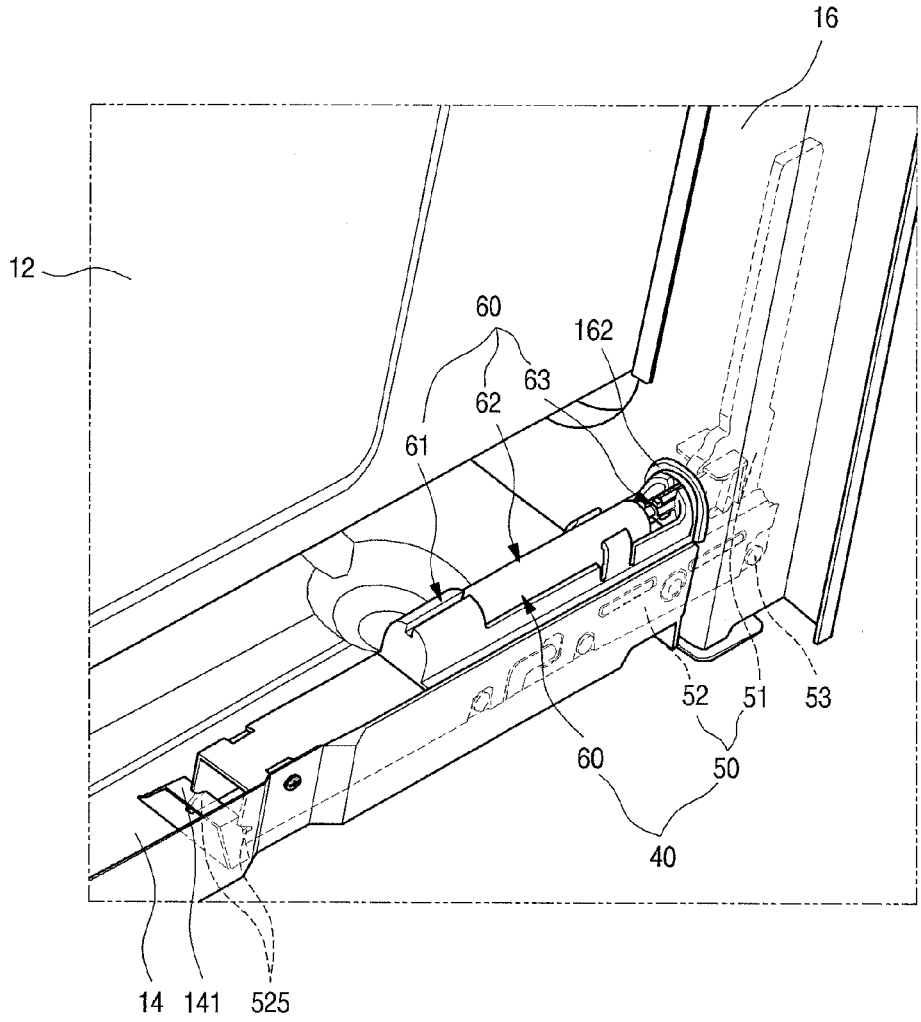
FIG. 4 is a partial perspective view illustrating a state in which a hinge apparatus is installed at a main body of the oven.

FIG. 3 is an enlarged view of an A portion of FIG. 2. And FIG. 4 is a partial perspective view illustrating a state in which the hinge apparatus is installed at the main body of the oven.

As illustrated in the drawings, the hinge apparatus 40 may be provided at both corners of a lower portion of the front surface of the main body 10. The hinge apparatus 40 may be fixed to a hinge fixing part 141 formed at an upper surface of the lower plate 14.

A hinge hole 162 is formed at both of left and right sides of a lower portion of the front plate 16 to be opened. The hinge hole 162 is formed to correspond to a cross section of the hinge apparatus 40, and thus the hinge apparatus 40 may be inserted and assembled through the hinge hole 162, and may be formed to be exposed through the hinge hole 162 while being installed at the main body 10.

That is, the hinge apparatus 40 is inserted from a front through the hinge hole 162, and a rear end of the hinge apparatus 40 is inserted and restricted into the hinge fixing part 141, and a first half portion of the hinge apparatus 40 is restricted by the hinge hole 162, and may be maintained in a fixed state to the main body 10.

A damping unit 60 which is installed at a hinge body 52 forming a hinge unit 50 is disposed in the hinge hole 162, and a first half portion of the hinge body 52 and a front surface 613 of the damping unit 60 may be exposed through the hinge hole 162.

At this point, the front surface 613 of the damping unit 60 and a front surface of the front plate 16 may be located on the same plane, and a shaft cap 63 forming the damping unit 60 may be formed to protrude to a front of the hinge hole 162.

And a hinge lever 51 coupled to the hinge body 52 is located at an area outside the main body 10, and formed to be coupled to the door 20. Therefore, the hinge lever 51 may be rotated together with the door 20 while the hinge body 52 is fixed.

Hereinafter, the hinge apparatus 40 will be described in detail with reference to the drawings.

Figure 5:
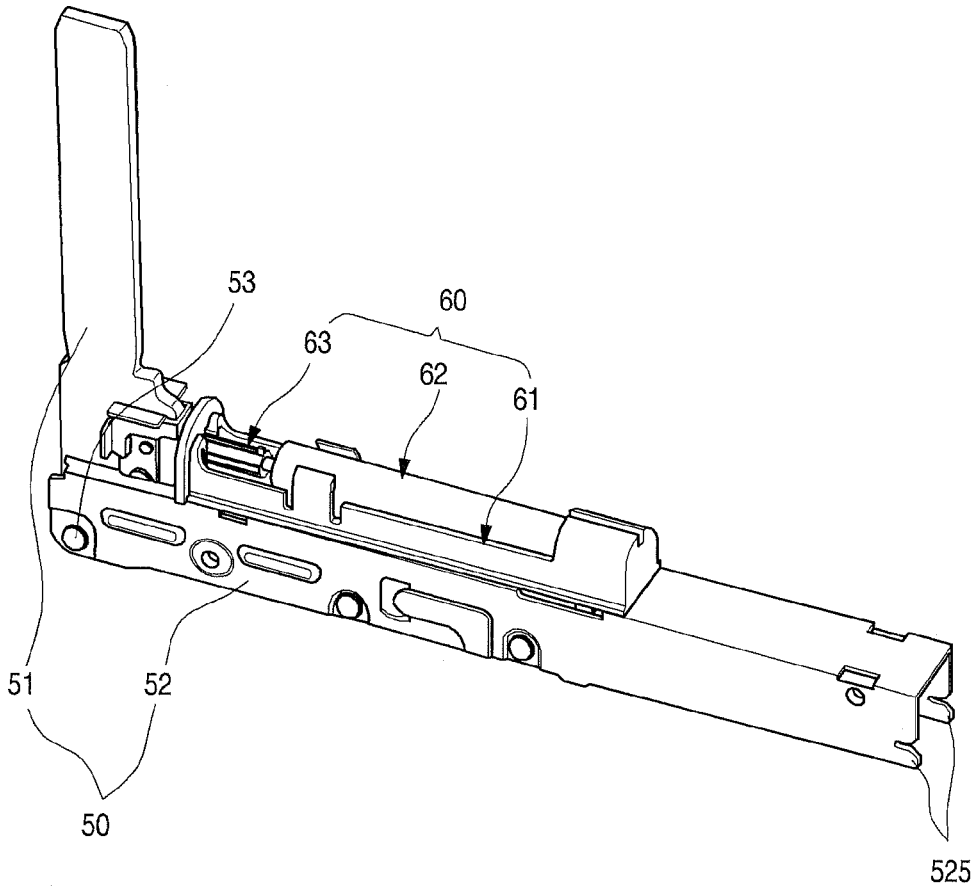
FIG. 5 is a perspective view of the hinge apparatus.
Figure 6:
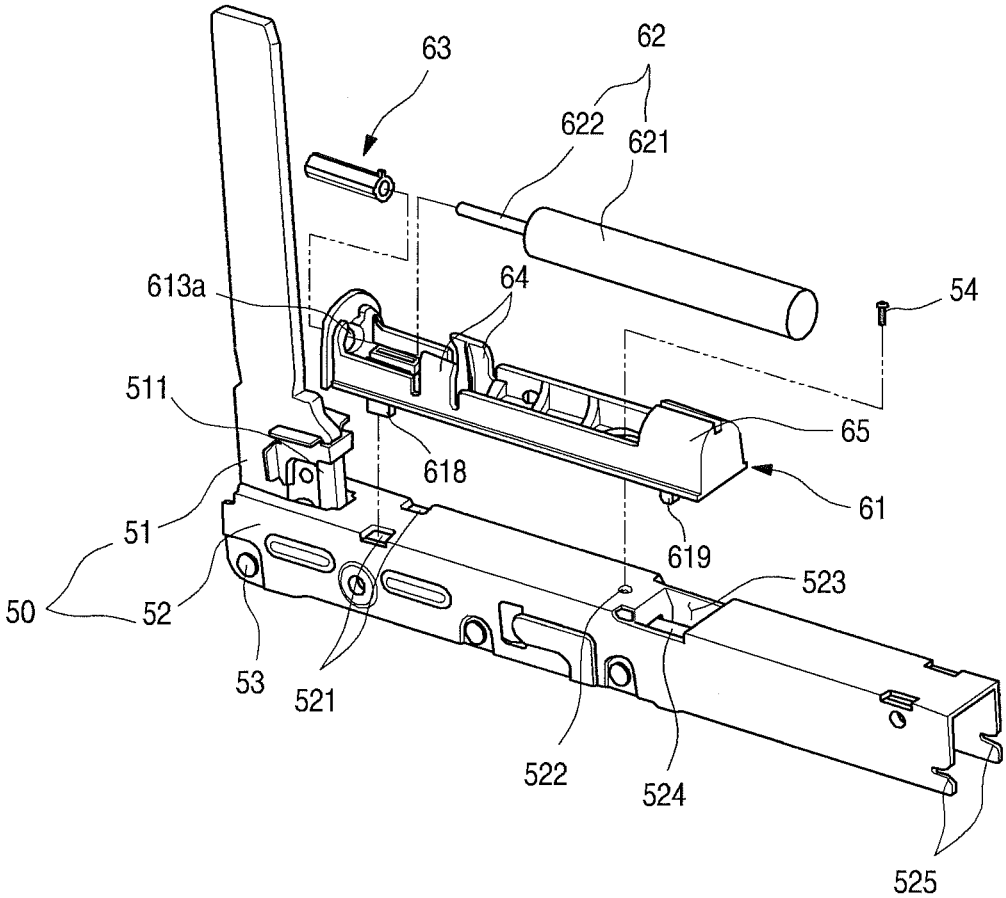
FIG. 6 is an exploded perspective view of the hinge apparatus.

FIG. 5 is a perspective view of the hinge apparatus. And FIG. 6 is an exploded perspective view of the hinge apparatus.

As illustrated in the drawings, the hinge apparatus 40 may generally include the hinge unit 50 for the rotation of the door 20, and the damping unit 60 which is coupled to the hinge unit 50 and absorbs a shock applied to the hinge unit 50.

The hinge unit 50 may include the hinge lever 51 which is coupled to the door 20, and the hinge body 52 which is installed and fixed to the main body 10. And the hinge lever 51 and the hinge body 52 may be coupled by a hinge pin 53, and thus the hinge lever 51 may be rotated about the hinge pin 53 while being coupled to the hinge body 52.

The hinge lever 51 is formed to extend in a predetermined length, and an extending portion thereof may be coupled to one side of the door 20. And a lower end of the hinge lever 51 may be shaft-coupled to the hinge body 52 by the hinge pin 53 and thus may be rotated.

And a contacting part 511 may be formed at one side of the hinge lever 51 close to the hinge body 52. The contacting part 511 may be formed to protrude toward the damping unit 60, and may be formed to have a predetermined curvature or to be inclined and thus to be smoothly in contact with the damping unit 60.

Therefore, when a rotating operation is performed to close the door 20, the hinge lever 51 may be rotated, and the contacting part 511 may become in contact with the shaft cap 63 of the damping unit 60, and thus may press a shaft 622 of the damping unit 60 according to the rotation of the door 20.

The hinge body 52 may be installed and fixed to the hinge fixing part 141 of the main body 10, and the first half portion thereof may be formed to pass through the hinge hole 162 which is opened at the front plate 16, and then to protrude forward. The first half portion of the hinge body 52 is coupled to the hinge lever 51 by the hinge pin 53.

And although not illustrated in detail, a guide member 524 which is connected to the hinge lever 51 is provided inside the hinge body 52, and a spring (not shown) which is compressed or stretched depending on movement of the guide member 524 may be provided.

Therefore, if the hinge lever 51 is rotated when the door 20 is opened, the spring is stretched while the guide member 524 is moved, and thus the user may operate the door 20 not to be suddenly opened but to be naturally and slowly opened. Since such a structure of the guide member 524 and the spring is generally provided at the oven or a cooking appliance, detailed description thereof will be omitted.

Meanwhile, a first coupling hole 521, a second coupling hole 522 and a third coupling hole 523 for installing the damping unit 60 may be formed at an upper surface of the hinge body 52. The first coupling hole 521 is formed at each of left and right sides so that one pair of first case fixing protrusions 618 formed to protrude from a lower surface of the damping unit 60 are inserted therein. Therefore, the first case fixing protrusions 618 may be inserted into the first coupling holes 521, and then may be hooked and restricted therein, and thus the damping unit 60 may be installed and fixed to the hinge body 52.

The second coupling hole 522 is formed at a position corresponding to a screw fastening hole 615 formed at a bottom surface of the damping unit 60. And a screw 54 which is fastened from an upper side of the damping unit 60 may pass through the screw fastening hole 615 and the second coupling hole 522, and may be fastened therein. Therefore, the damping unit 60 may be installed and fixed to the upper surface of the hinge body 52.

The third coupling hole 523 is formed to be opened, such that one pair of second case fixing protrusions 619 protruding from the lower surface of the damping unit 60 are accommodated therein. The third coupling hole 523 may be defined by partially cutting and then bending inward a part of the upper surface of the hinge body 52. At this point, the bent part of the hinge body 52 may be formed to guide movement of the guide member 524 located therein. The second case fixing protrusions 619 may be inserted into an opened inside of the third coupling hole 523, and may be supported by an end of the third coupling hole 523, and thus the damping unit 60 may be supported so as not to be pushed even when a force is exerted backward to the damping unit 60.

A hinge fixing groove 525 is provided at a rear end of the hinge body 52. The hinge fixing groove 525 is hooked and restricted by the hinge fixing part 141 of the lower plate 14, and thus the hinge body 52 may be fixed. And although not illustrated, the hinge body 52 may be further fixed to the lower plate 14 by a separate coupling structure or coupling member.

Figure 7:
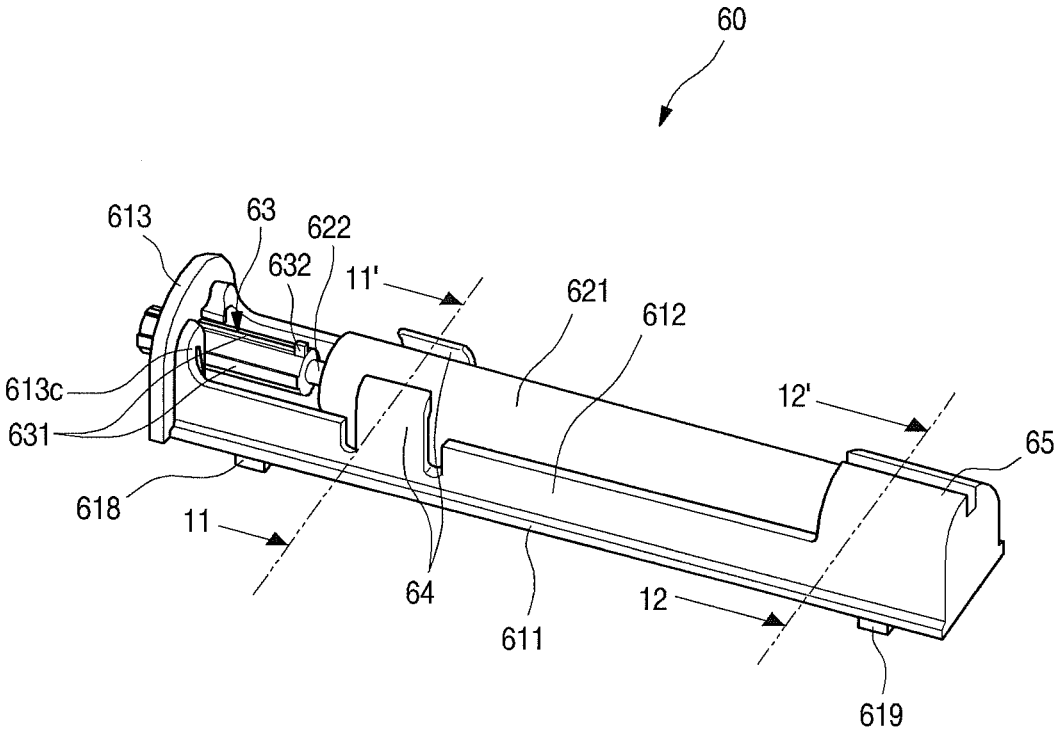
FIG. 7 is a perspective view of a damping unit as one configuration of the hinge apparatus.
Figure 8:
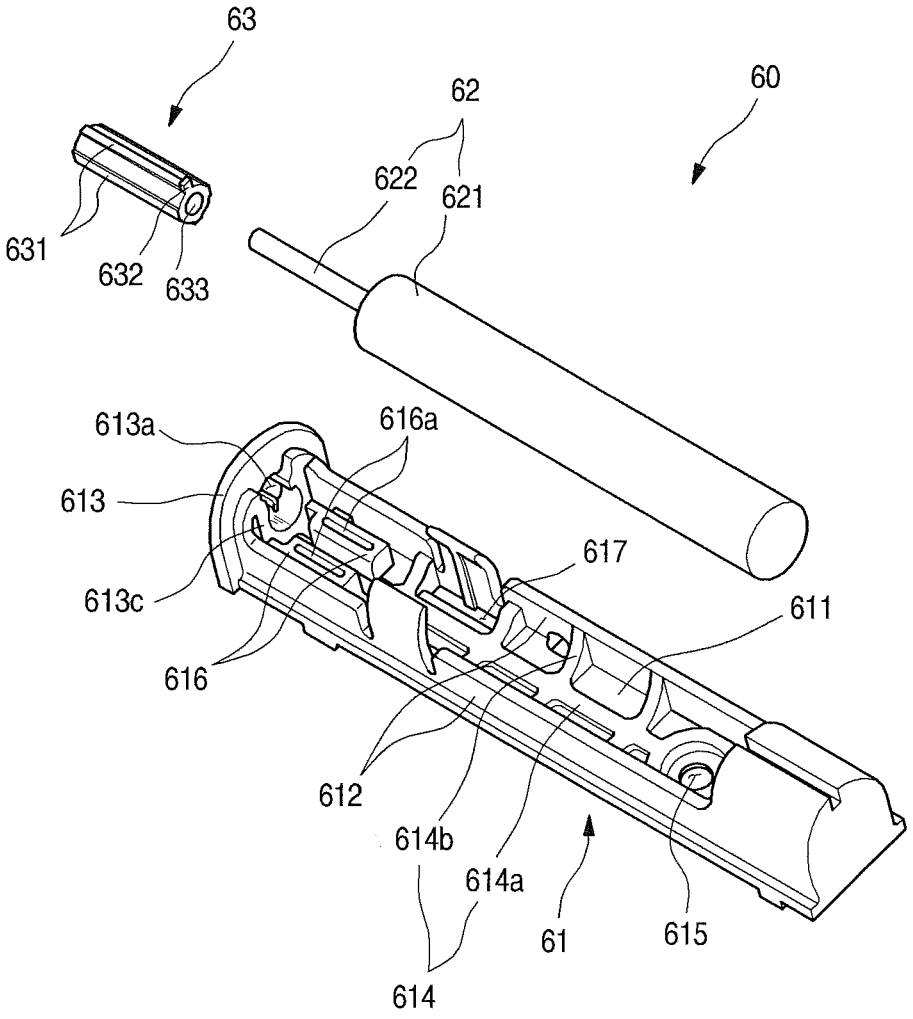
FIG. 8 is an exploded perspective view of the damping unit.
Figure 9:
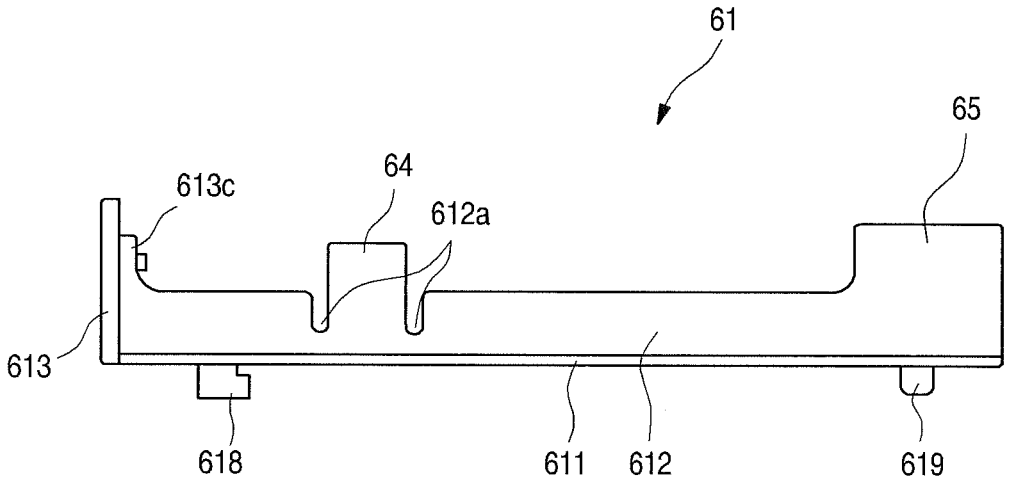
FIG. 9 is a side view of a damper case as one configuration of the damping unit.
Figure 10:
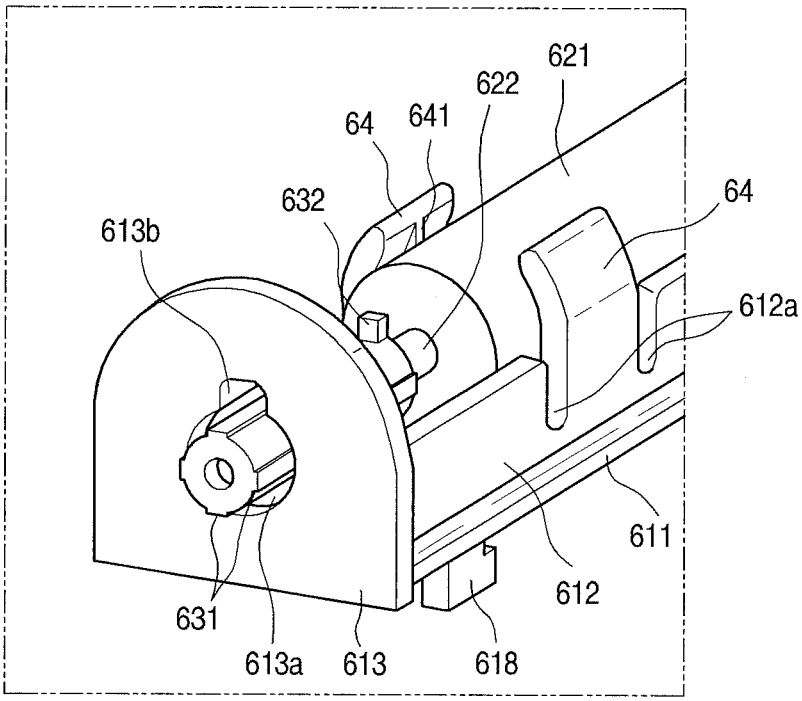
FIG. 10 is a partial perspective view of the damping unit when being seen from a front thereof.

FIG. 7 is a perspective view of the damping unit as one configuration of the hinge apparatus. And FIG. 8 is an exploded perspective view of the damping unit. And FIG. 9 is a side view of a damper case as one configuration of the damping unit. And FIG. 10 is a partial perspective view of the damping unit when being seen from a front thereof.

The damping unit 60 will be described in detail with reference to the drawings. The damping unit 60 may include a damper case 61 which is installed and fixed to the hinge body 52, a damper 62 which is installed inside the damper case 61, and the shaft cap 63 which is installed at an end of the shaft 622 of the damper 62.

The damper 62 may include a cylindrical housing 621, and the shaft 622 which passes through a front surface of the housing 621 and then protrudes. A piston (not shown) which is moved together with the shaft 622 may be provided inside the housing 621, and an inside of the housing 621 may be filled with oil so as to reduce a moving speed of the piston and thus to perform a damping action. Since such a structure of the damper 62 is generally provided, detailed description thereof will be omitted.

Meanwhile, the shaft cap 63 is provided at a front end of the shaft 622. The shaft cap 63 has a cylindrical shape, and also has an opening 633 formed at a rear end thereof so that the shaft 622 is inserted from a rear of the shaft cap 63. Therefore, the shaft cap 63 may be formed to be coupled to the shaft 622 and thus to be moved together when the shaft 622 is moved forward and backward.

A plurality of guide parts 631 are formed at a circumference of the shaft cap 63 in a lengthwise direction. The guide parts 631 extend from a front end of the shaft cap 63 to a rear end thereof, and protrude outside by a predetermined height. The plurality of guide parts 631 are formed to face each other. Preferably, four guide parts 631 may be arranged at an angle of 90° with respect to each other based on a center of the shaft cap 63.

And a cap protrusion 632 is further formed outward from the rear end of the shaft cap 63. The cap protrusion 632 may be formed to protrude from an outer surface of the shaft cap 63 and also to have a size which passes through an alignment groove 613*b* which will be described below. At this point, the cap protrusion 632 may be formed at a rear end of one of the plurality of guide parts 631. Therefore, when the shaft cap 63 is installed, the cap protrusion 632 may be installed so as to pass through the alignment groove 613*b*, and thus the guide parts 631 may be coupled to the shaft 622 in an aligned state.

The damper case 61 has a shape of which an upper portion is opened to accommodate the damper 62, and also has a structure in which a lower surface 611, a part of each of left and right side surfaces 612, the front surface 613 and a rear surface thereof are shielded. Therefore, the damper 62 may be inserted into the damper case 61 in a fitting method from an upper side toward a lower side. And a front fixing part 64 and a rear fixing part 65 are formed to fix the damper 62, and the damper 62 may be formed to be maintained in a fixed state to an inside of the damper case 61.

A housing support part 614 is formed at an inner lower surface 611 of the damper case 61. The housing support part 614 may be formed at a position corresponding to the housing 621 when the damper 62 is installed at the damper case 61, and may support the housing 621.

And the housing support part 614 may include a first support part 614*a* which extends in a lengthwise direction of the damper case 61, and a second support part 614*b* which is formed to cross the inside of the damper case 61 and thus to intersect with the first support part 614*a*.

The first support part 614*a* extends along a center of the inner lower surface of the damper case 61, and supports a center portion of the housing 621 from a lower side thereof when the damper 62 is installed. The second support part 614*b* vertically intersects with the first support part 614*a*, and a plurality of second support parts 614*b* may be provided at regular intervals in an extending direction of the first support part 614*a*.

The second support part 614*b* may be formed to be in contact with the lower surface 611 and the left and right side surfaces 612 of the damper case 61, and may also be formed so that each of the inner side surfaces 612 is rounded with a curvature corresponding to an outer circumferential surface of the housing 621 so as to cover a circumference of the housing 621. Therefore, when the damper 62 is installed, the plurality of second support parts 614*b* may cover and support the outer circumferential surface of the housing 621.

And the screw fastening hole 615 is formed at a rear end of the first support part 614*a*. The screw fastening hole 615 is formed to be opened, such that the damping unit 60 is coupled and fixed to the hinge body 52 by the screw 54.

A shaft guide part 616 may be further formed at a front of the housing support part 614. One pair of shaft guide parts 616 are provided at both of left and right sides, and disposed to be spaced apart from each other based on a center of the damper case 61.

The shaft guide part 616 is formed to have a predetermined length, and extends upward from the lower surface of the damper case 61. And a guide rib 616*a* may be formed on an upper surface of the shaft guide part 616. Therefore, when the shaft cap 63 is moved forward and backward, one pair of guide parts 631 which extend left and right, among the plurality of guide parts 631 of the shaft cap 63, are supported by the guide rib 616*a*, and another guide part 631 which extends downward may be reciprocated forward and backward while passing through between the shaft guide parts 616.

When a force is transmitted to the shaft cap 63 or the shaft 622 due to contact with the contacting part 511 by rotation of the hinge lever 51, the force may be transmitted in a direction inclined with respect to the shaft 622, instead of a direction parallel with the shaft 622, and thus an eccentric force may be applied to the shaft 622.

However, since the guide parts 631 are formed to protrude radially, the shaft cap 63 is primarily in contact with a shaft hole 613*a*, and guides the shaft 622 so as not to be eccentric, and is also secondarily supported by the guide rib 616*a* and the shaft guide part 616 so as not to be eccentric or not to be moved. Therefore, even when the force applied to the shaft 622 acts in an eccentric direction, the shaft 622 is not eccentric while being moved, and thus the damping action may be stably performed without damage of an internal structure of the housing 621.

Meanwhile, one pair of bottom holes 617 are formed at the lower surface 611 of the damper case 61. Each of the bottom holes 617 is formed at a position corresponding to a lower end of the front fixing part 64, and also has a width corresponding to that of the front fixing part 64.

Therefore, the bottom holes 617 may be formed to provide an evacuation structure of a mold for molding the front fixing part 64 when the damper case 61 is injection-molded. That is, when the damper case 61 is injection-molded, a part of the mold may be moved in and out through the bottom holes 617, and thus the front fixing part 64 formed to extend to an upper side of the damper case 61 and to be rounded inward may be molded.

And the first case fixing protrusion 618 and the second case fixing protrusion 619 which protrude down are formed at the lower surface of the damper case 61, and thus the damper case 61 may be installed at and fixed to the hinge body 52.

Specifically, the first case fixing protrusion 618 is formed to extend downward from both of left and right side ends of a lower surface of a first half portion of the damper case 61 which corresponds to a position of the first coupling hole 521. At this point, the first case fixing protrusion 618 may be formed in a hook shape, and may be hooked and restricted to the first coupling hole 521.

And the second case fixing protrusion 619 is located at a second half portion of the damper case 61 which is spaced apart from the first case fixing protrusion 618, and one pair of second case fixing protrusions 619 may be formed at both of left and right sides thereof. The second case fixing protrusion 619 is formed to extend downward and thus to be inserted and supported into the third coupling hole 523.

The front surface 613 of the damper case 61 is formed to have a predetermined area and thus to cover a front of the damper 62 while the damper 62 is installed at the damper case 61. And the front surface 613 of the damper case 61 may be formed to have a corresponding shape which shields a part of the hinge hole 162 formed at the front plate 16. And the front surface 613 of the damper case 61 may be formed to be exposed forward when the door 20 is opened in a state in which the hinge apparatus 40 is installed at the main body 10.

The shaft hole 613*a* is formed at the front surface 613 of the damper case 61. The shaft hole 613*a* serves to enable the shaft cap 63 ad the shaft 622 to be moved in and out therethrough, and may be formed to be opened at a position corresponding to the shaft 622 while the damper 62 is installed.

The shaft hole 613*a* is formed in a circular shape having an inner diameter which is slightly larger than a diameter of the shaft cap 63, and thus enables the shaft cap 63 to be easily moved in and out. At this point, the inner diameter of the shaft hole 613*a* may be formed to have a size which is close to the guide parts 631 of the shaft cap 63.

Therefore, when the door 20 is closed, even though the contacting part 511 of the hinge lever 51 exerts the force to the shaft 622 in the inclined direction, the shaft cap 63 is guided by the shaft hole 613*a*, and thus the shaft 622 of the damper 62 may be inserted inside the housing 621 while being maintained in a normal state which is not eccentric.

Meanwhile, the alignment groove 613*b* is further formed at one side of the shaft hole 613*a*. The alignment groove 613*b* serves to enable the shaft cap 63 to be located in position when the shaft cap 63 is installed, and is formed to have a size through which the cap protrusion 632 passes. Therefore, when the shaft cap 63 is installed, the shaft cap 63 may be aligned by the alignment groove 613*b* and the cap protrusion 632, and thus may be installed in position. Therefore, when the shaft cap 63 is installed, a part of the guide parts 631 of the shaft cap 63 may be located between the shaft guide parts 616, and another part thereof may be supported by the guide rib 616*a*.

Meanwhile, a reinforcing part 613*c* may be further formed at a back surface of the front surface 613 of the damper case 61, i.e., an inner side surface of a space in which the damper 62 is installed. The reinforcing part 613*c* is formed to protrude along a circumference of the hinge hole 162, and further expands an inner side surface of the hinge hole 162, and thus may allow more stable contact with the guide parts 631, and may also reinforce strength of the front surface 613 of the damper case 61. The reinforcing part 613*c* is formed along the circumference of the hinge hole 162 except the alignment groove 613*b*, and also formed to be connected with the side surfaces 612 and the lower surface 611 of the damper case 61.

The side surfaces 612 of the damper case 61 are formed to extend upward from both of left and right side ends of the lower surface 611 of the damper case 61. The side surfaces 612 of the damper case 61 may be formed lower than a height of the housing 621 so that the housing 621 is exposed when the housing 621 is installed.

And one pair of front fixing parts 64 are formed at one side of the side surfaces 612 of the damper case 61, and the front fixing parts 64 are formed to fix a first half portion of the housing 621 when the damper 62 is installed. And the rear fixing part 65 is formed at a rear end of the damper case 61 to accommodate a second half portion of the housing 621, such that the damper 62 is further fixed when the damper 62 is installed.

Figure 11:
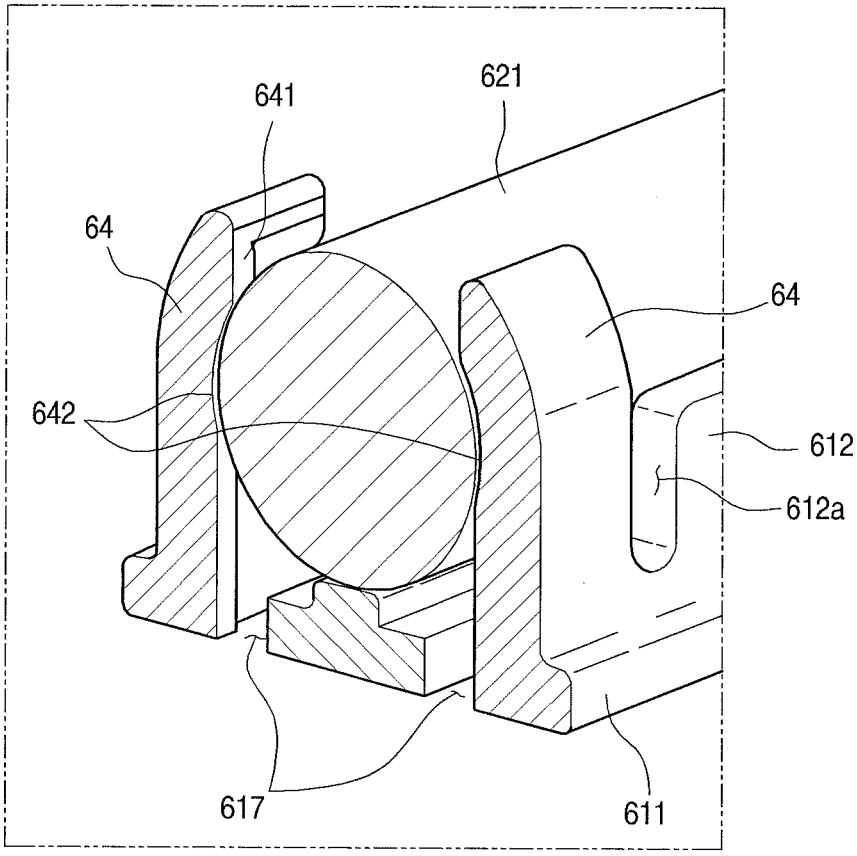
FIG. 11 is a partially cut-away perspective view taken along line 11-11' of FIG. 7.

FIG. 11 is a partially cut-away perspective view taken along line 11-11' of FIG. 7.

As illustrated in the drawing, the front fixing parts 64 are formed at the side surfaces 612 of the damper case 61 corresponding to positions of the bottom holes 617, and one pair of front fixing parts 64 are formed to face each other at both of left and right sides. And the front fixing parts 64 may be formed to extend upward further than the side surfaces 612 of the damper case 61 and thus to cover the housing 621.

And a cut-away part 612*a* may be formed at each of the side surfaces 612 of the damper case 61 corresponding to both of the left and right side ends of each of the front fixing parts 64, and thus the front fixing parts 64 may be formed to have elasticity. Therefore, when the damper 62 is installed at the damper case 61, the front fixing parts 64 may be elastically deformed, and the damper 62 may be easily installed.

The front fixing parts 64 may be formed to extend upward, and an upper portion of each of the front fixing parts 64 may be formed to be rounded, to cover the housing 621 when the damper 62 is installed, and also to press and fix an outer surface of the housing 621.

A front pressing part 641 which extends vertically may be further formed at a center of an inner surface of each of the front fixing parts 64. The front pressing part 641 may protrudes inward, may be in contact with the outer surface of the housing 621, and thus may press and support the housing 621. At this point, a recessed part 642 which is roundly recessed along the circumference of the housing 621 may be further formed at the inner surface of each of the front fixing parts 64, and may be in close contact with the outer surface of the housing 621.

Meanwhile, a distance between the pair of front fixing parts 64 which face each other may be formed smaller than a diameter of the housing 621. Therefore, while the damper 62 is installed at the front fixing parts 64, the front fixing parts 64 are tensed to press the outer surface of the housing 621 and thus to be maintained in a closely contacting state with the outer surface of the housing 621. Therefore, the damper 62 may be maintained in a fixed state to the inside of the damper case 61.

Figure 12:
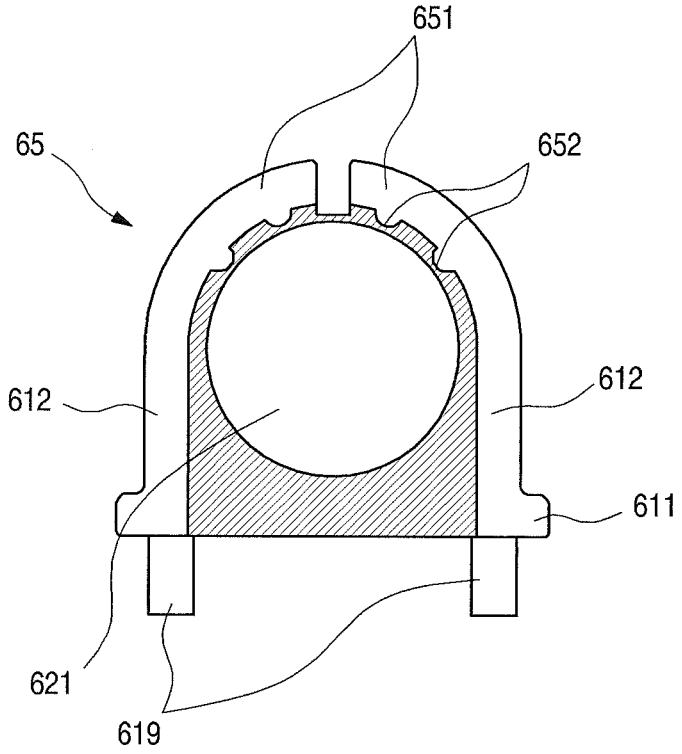
FIG. 12 is a cross-sectional view taken along line 12-12' of FIG. 7.

FIG. 12 is a cross-sectional view taken along line 12-12' of FIG. 7.

As illustrated in the drawing, the rear fixing part 65 is located at the rear end of the damper case 61. The rear fixing part 65 may form a predetermined space inside the damper case 61 to accommodate a rear end of the damper 62.

The rear fixing part 65 may be defined by an extending part 651 which extends from the rear surface of the damper case 61 and the side surfaces of the damper case 61. One pair of extending parts 651 are formed at both of left and right sides based on the center of the damper case 61, disposed to be spaced apart from each other, and formed to be elastically deformed when the damper 62 is fitted.

The extending part 651 is formed to have a predetermined width, and may fix a second half of the damper 62 while being inserted into the rear end of the damper 62. And a rear pressing part 652 which extends horizontally in a lengthwise direction of the extending part 651 is further formed at an inner surface of the extending part 651. A plurality of rear pressing parts 652 are disposed at regular intervals, and formed to press and fix the outer surface of the damper 62 when the damper 62 is inserted.

A space inside the extending part 651 is formed to correspond to the diameter of the housing 621. Therefore, when the damper 62 is inserted, the housing 621 may be in contact with the rear pressing part 652, and the extending part 651 may be elastically deformed. That is, the damper 62 may be fitted into a space of the rear fixing part 65, and the extending part 651 may be tensed by the fitting of the damper 62, and thus may press the housing 621.

Like this, while the damper 62 is installed at the damper case 61, the damper 62 may be restricted at three points which are the shaft hole 613*a*, the front fixing part 64 and the rear fixing part 65. Accordingly, the damper 62 may be maintained in a stably installed state even when the eccentric force is applied.

Hereinafter, an operation of the hinge apparatus 40 according to the embodiment of the present invention having the above-described structure will be described in detail with reference to the drawings.

Figure 13:
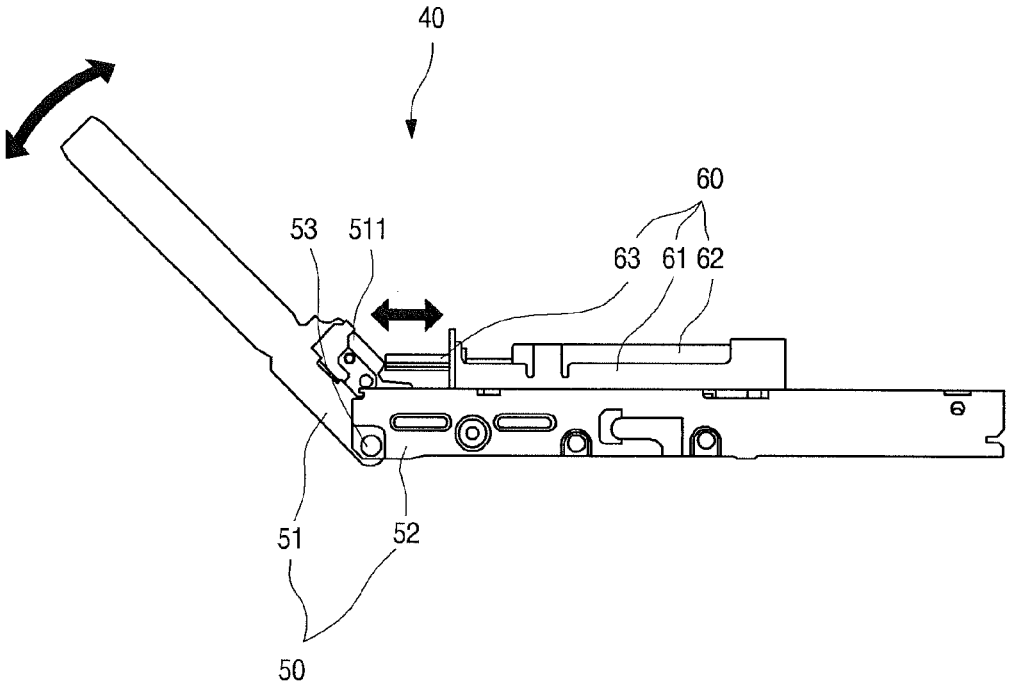
FIG. 13 is a view illustrating a state of the hinge apparatus when the door of the oven is opened.
Figure 14:
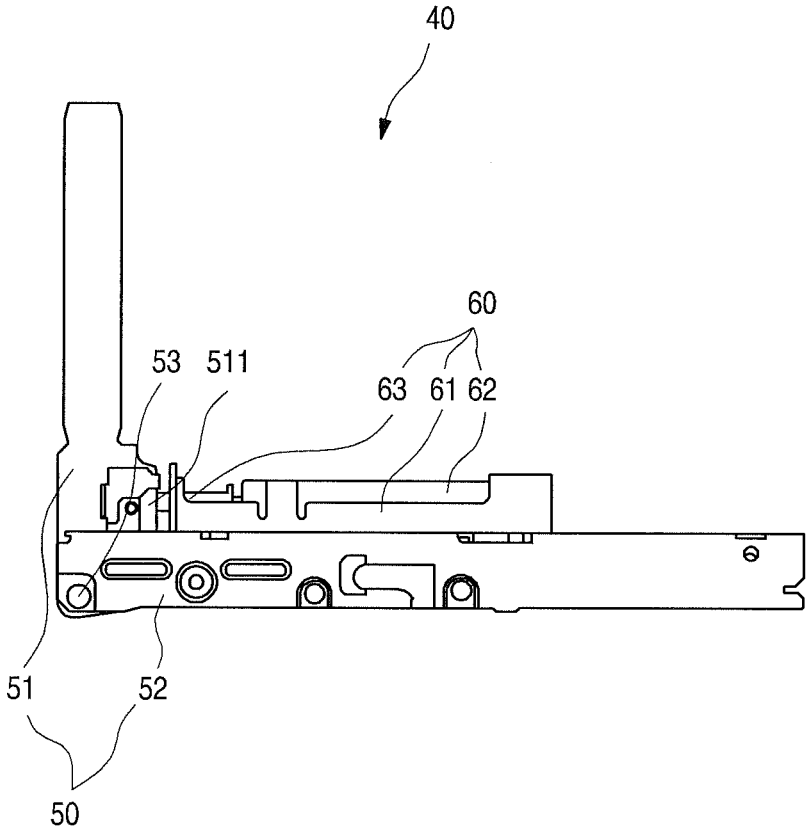
FIG. 14 is a view illustrating a state of the hinge apparatus when the door of the oven is closed.

FIG. 13 is a view illustrating a state of the hinge apparatus when the door of the oven is opened. And FIG. 14 is a view illustrating a state of the hinge apparatus when the door of the oven is closed.

Referring to the drawings, when the user grips and pulls the door handle 21 while the door 20 is closed, the door 20 is rotated about the lower end thereof, and the cooking space 11 is opened. At this point, the hinge apparatus 40 is rotated together with the door 20.

Specifically, due to the rotation of the door 20, the hinge lever 51 coupled to the door 20 is rotated counterclockwise using the hinge pin 53 as an axis. And in a state in which the hinge body 52 is installed and fixed to the main body 10, the hinge body 52 supports such that only the hinge lever 51 may be rotated.

When the hinge lever 51 is rotated counterclockwise, the guide member 524 connected to the hinge lever 51 is withdrawn, and the spring inside the hinge body 52 is stretched due to withdrawing of the guide member 524, and the rotating speed of the hinge lever 51 is reduced, and thus the user may safely and slowly rotate the door 20.

In particular, when the door 20 is initially opened, the user should pull the door 20 with a force greater than a repulsive force of the spring (not shown). Therefore, the door 20 may be prevented from being opened suddenly or rapidly, and the user may use the oven more safely.

Meanwhile, as the hinge lever 51 is rotated counterclockwise, the shaft 622 of the damping unit 60 which is pressed by the contacting part 511 of the hinge lever 51 may be withdrawn from the housing 621. When the hinge lever 51 is rotated above a preset angle, and the door 20 is opened, the withdrawing of the shaft 622 may be completed. At this point, the shaft cap 63 coupled to the shaft 622 may be separated from the contacting part 511, as illustrated in FIG. 13.

Due to such an action of the hinge apparatus 40, the door 20 may be opened, and the user may put the food into or take the food out of the cooking space 11 by the opening of the door 20.

To close the door 20 after the door 20 is opened, the user rotates the door 20 by gripping and pushing the door handle 121. Due to the rotation of the door 20, the hinge apparatus 40 is also rotated, and the door 20 is closed, and thus the cooking space 11 may be sealed.

Specifically, when the door 20 is rotated in a closing direction, the hinge apparatus 40 in a state of FIG. 13 is rotated clockwise about the hinge pin 53.

When the hinge lever 51 is rotated clockwise, the guide member 524 which is connected to the hinge lever 51 is moved horizontally, and the spring which is stretched according to movement of the guide member 524 is returned to its original state.

Meanwhile, when the hinge lever 51 in the state of FIG. 13 is rotated clockwise above the preset angle, the contacting part 511 of the hinge lever 51 starts to become in contact with the shaft cap 63. Due to the contact with the shaft cap 63, the shaft 622 may be inserted inside the housing 621 according to the clockwise rotation of the hinge lever 51.

When the hinge lever 51 is gradually rotated clockwise, the shaft 622 may be gradually inserted inside the housing 621. And due to the inserting of the shaft 622, resistance against movement of the shaft 622 occurs by the oil inside the housing 621, and the force which is transmitted to the shaft 622 is offset. That is, a moving speed of the shaft 622 is reduced, and thus the rotating speed of the hinge lever 51 which is in contact with the shaft cap 63 may be reduced.

Therefore, in a process in which the door 20 is closed, a closing speed of the door 20 may be delayed by the damping unit 60 of the hinge apparatus 40. Accordingly, a noise which is generated when the door 20 is closed may be reduced, and the user may more safely operate the door 20.

According to the proposed embodiment of the present invention, since the damping unit is installed at the outer upper surface of the hinge unit, the hinge apparatus can be easily assembled, and thus productivity can be enhanced. In addition, a change in an internal structure of the hinge unit is not required, and a structure of the hinge unit can be simplified.

Since the present invention has a structure in which the damping unit is installed outside the hinge unit, the damping unit can be simply installed at a preset position of the hinge unit, regardless of a size or a type of a model, and thus a change in the structure of the hinge unit is not required, and design variability which can be applied to various models can be ensured.

In addition, since the damping unit is installed at the upper side of the hinge unit, installing of the hinge apparatus can be performed using an existing space without securing of a separate space in the oven.

Also, since the damping unit can directly act on the hinge lever which is installed at the upper surface of the hinge unit to be rotated, closing of the door can be simply and intuitively controlled, and thus reliability in the operation can be ensured. Further, the rotating speed of the oven door can be efficiently reduced, and thus a noise can be reduced.

And a contacting time between the hinge lever and the damping unit can be controlled by adjusting the installation position of the damping unit or a length of the shaft cap, and thus a deceleration time and a deceleration degree can be easily controlled when the oven door is closed.

Also, since the shaft cap which is in contact with the hinge lever is prevented by the hinge hole and the shaft guide from being eccentric, even though the force by the hinge lever in an eccentric direction is applied to the shaft cap, the shaft can be moved without being eccentric, and thus the damage of the damper can be prevented, and durability can also be enhanced.

Since the damping unit includes the hinge case which is installed at the hinge body and the damper which is installed at the hinge case, when it is intended that a damping sensitivity upon the rotation of the door is changed, the damping sensitivity can be easily and rapidly controlled by only a simple operation of replacing the damper.

Also, due to a structural characteristic in which the damping unit is installed at an outside of the hinge body, i.e., the upper surface of the hinge body exposed to an outside of the cavity plate, a replacing operation of the damper can be easily performed.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An oven, comprising:

a main body that defines a cooking space;

a door configured to open and close the cooking space; and a hinge apparatus configured to rotatably connect the door to the main body, wherein the hinge apparatus comprises:

a hinge unit with a hinge body fixed to the main body, and a hinge lever that is coupled to the door and rotatably coupled to the hinge body by a hinge pin; and a damping unit that is installed within a radius of rotation of the hinge lever at an outer surface of the hinge body, and that is configured to contact the hinge lever during rotation of the hinge lever, wherein the damping unit comprises:

a damper case that is fixed to the hinge body; and a damper that comprises a housing installed at the damper case, and a shaft that is configured to contact the hinge lever, and that is configured to move in and out of the housing.

2. The oven according to claim 1, wherein the hinge apparatus is provided at each of a left side and a right side of the main body, and wherein the damping unit is provided at one of the left side and the right side.

3. The oven according to claim 1, wherein the hinge body is mounted to a lower plate that defines a lower surface of the main body, and the damping unit is installed at an upper surface of the hinge body.

4. The oven according to claim 1, wherein the damping unit is configured to pass through a front plate that defines a front surface of the main body.

5. The oven according to claim 4, wherein a front surface of the damping unit and a front surface of the front plate are located on the same plane.

6. The oven according to claim 4, wherein the front plate defines a hinge hole, and the hinge body and the damping unit are configured to pass through the hinge hole.

7. The oven according to claim 6, wherein the hinge hole has a shape that corresponds to a shape of a circumferential surface of the hinge body and a front surface of the damping unit.

8. The oven according to claim 1, wherein the damping unit is provided at a space that is defined by a cavity plate, a front plate that defines a front surface of the main body, and a lower plate that defines a lower surface of the main body.

9. The oven according to claim 1, wherein the shaft is configured to pass through a front surface of the main body, and configured to be pressed by the hinge lever based on the hinge lever being rotated.

10. A hinge apparatus comprising:

a hinge unit with a hinge body fixed to a main body of an oven, and a hinge lever that is coupled to a door of the oven and rotatably coupled to the hinge body by a hinge pin; and a damping unit that is installed within a radius of rotation of the hinge lever at an outer surface of the hinge body, and that is configured contact the hinge lever during rotation of the hinge lever, wherein the damping unit comprises, a damper case that is fixed to the hinge body; and a damper that comprises a housing installed at the damper case, and a shaft that is configured to contact the hinge lever, and that is configured to move in and out of the housing.

11. The hinge apparatus according to claim 10, wherein the hinge lever has a contacting part that is configured to protrude toward the damping unit and press a shaft of the damping unit based on the hinge lever being rotated.

12. The hinge apparatus according to claim 10, wherein an upper surface of the hinge body defines a first coupling hole and the damping unit is configured to couple to the first coupling hole.

13. The hinge apparatus according to claim 12, wherein a pair of first case fixing protrusions are located at both sides of a lower surface of the damping unit, each of the case fixing protrusions having a hook shape and being configured to insert into the first coupling hole.

14. The hinge apparatus according to claim 12, wherein the upper surface of the hinge body defines a second coupling hole and a screw that passes through the damping unit is configured to fasten to the second coupling hole.

15. The hinge apparatus according to claim 12, wherein an upper surface of the hinge body defines a third coupling hole and wherein a second case fixing protrusion extending from a lower surface of the damping unit is configured to be inserted into the third coupling hole.

16. The hinge apparatus according to claim 10, wherein the damper case is configured to open upward, and the damper is configured to be fitted and installed through an opened upper surface of the damper case.

17. The hinge apparatus according to claim 10, wherein a housing support part is located at a lower surface of the damper case and is configured to extend outward to contact the housing, and the housing support part comprises a first support part that is configured to extend along a center of the housing, and a second support part that is located at a predetermined interval along the first support part and configured to intersect with the first support part, and the housing support part includes a corresponding curved surface configured to cover an outer surface of the housing.

18. The hinge apparatus according to claim 10, wherein the damper case comprises a front fixing part that presses and fixes an outer surface of the housing, and a rear fixing part that defines a space at a rear end of the damper case in which a rear end of the housing is inserted.

19. The hinge apparatus according to claim 18, wherein the front fixing part is rounded inward with a curvature corresponding to the outer surface of the housing, and a lower surface of the damper case defines a bottom hole that corresponds to a lower end of the front fixing part.

20. The hinge apparatus according to claim 18, wherein a front pressing part is located at an inner surface of the front fixing part and is configured to extend to contact the outer surface of the housing.

21. The hinge apparatus according to claim 18, wherein a recessed part is located at an inner surface of the front fixing part and is configured to accommodate a part of the outer surface of the housing.

22. The hinge apparatus according to claim 18, wherein a cut-away part is located at both sides of the front fixing part, the cut-away part being a cut side surface of the damper case to provide elasticity to the front fixing part.

23. The hinge apparatus according to claim 18, wherein the rear fixing part comprises a rear surface that is configured to extend upward from an end of the damper case to support the housing; and a pair of extending parts that extend from both of the side surfaces and the rear surface of the damper case and that are spaced apart from each other.

24. The hinge apparatus according to claim 23, wherein a plurality of rear pressing parts are located at inner surfaces of the extending parts and each of the plurality of rear pressing parts extend in a lengthwise direction of the extending parts and press the outer surface of the housing based on the housing being inserted.

25. The hinge apparatus according to claim 18, further comprising a shaft cap that is provided at a front end of the shaft, that is configured to pass through the damper case, and that contacts the hinge lever.

26. The hinge apparatus according to claim 25, wherein a plurality of guide parts are located at an outer circumferential surface of the shaft cap and each of the plurality of guide parts are configured to extend in a same direction as the shaft cap and protrude radially at predetermined intervals.

27. The hinge apparatus according to claim 26, wherein a front surface of the damper case defines a shaft hole and the shaft cap is configured to pass through the shaft hole.

28. The hinge apparatus according to claim 27, wherein a cap protrusion is located at an outer surface of the shaft cap and is configured to extend in a lateral direction.

29. The hinge apparatus according to claim 26, wherein a pair of shaft guide parts are located inside the damper case and are configured to be spaced apart from each other and support the guide parts to prevent eccentricity of the shaft cap.

* * * * *